US006235987B1

(12) United States Patent
Gamaggio-Schafer

(10) Patent No.: US 6,235,987 B1
(45) Date of Patent: May 22, 2001

(54) CABLE TIE

(75) Inventor: Michael Gamaggio-Schafer, Sachsenhauser Landwehrweg 229, D-60598 Frankfurt am Main (DE)

(73) Assignee: Michael Gamaggio-Schafer, Frankfurt (DE)

( * ) Notice: Subject to any disclaimer, the term of this patent is extended or adjusted under 35 U.S.C. 154(b) by 0 days.

(21) Appl. No.: 09/223,635

(22) Filed: Dec. 31, 1998

(30) Foreign Application Priority Data

Dec. 31, 1997 (DE) ..... 197 58 329

(51) Int. Cl.[7] ..... H02G 7/00
(52) U.S. Cl. ..... 174/40 CC; 174/60; 174/138 G
(58) Field of Search ..... 174/135, 138 G, 174/60, 72 A, 40 CC

(56) References Cited

U.S. PATENT DOCUMENTS

| | | | |
|---|---|---|---|
| 3,186,047 | 6/1965 | Schwester et al. | 24/16 |
| 3,397,430 | 8/1968 | Pearl | 24/16 |
| 3,562,870 | 2/1971 | Sund | 24/16 |
| 3,588,961 | 6/1971 | Farago | 24/16 |
| 3,739,429 | 6/1973 | Kohke | 24/16 |
| 5,836,053 * | 11/1998 | Davignon et al. | 24/16 PB |

FOREIGN PATENT DOCUMENTS

| | | |
|---|---|---|
| 1 486 076 | 3/1969 | (DE) . |
| 1 955 961 | 10/1970 | (DE) . |
| 7105162 | 7/1971 | (DE) . |
| 25 34 778 A1 | 2/1976 | (DE) . |
| 0 469 908 A1 | 2/1992 | (EP) . |
| 1035143 | 7/1966 | (GB) . |
| 1 316 862 | 5/1973 | (GB) . |

* cited by examiner

*Primary Examiner*—Dean A. Reichard
*Assistant Examiner*—Charlie C. Nguyen
(74) *Attorney, Agent, or Firm*—Oliff & Berridge, PLC

(57) ABSTRACT

Flat strip cable tie made of plastic, with two opposite metal edges (3 and 42, 43) in a pull-through opening for the anterior portion of the flat strap and cooperating barb-wise with marginal edges (15) on both sides of flat strip (1,12).

1 Claim, 1 Drawing Sheet

CABLE TIE

The invention relates to a cable tie in the form of a flat plastic strip provided at one end with a shaped head with an opening for passing the free end of the flat strip through and for locking in the head the flat strip part pushed through the head opening.

A cable tie of this kind is known from U.S. Pat. No. 3,186,047. In this known cable tie, the flat strip and head are made in one piece from plastic, the flat strip is conically tapered at its free end for easier introduction into the correspondingly shaped opening end of the flat head, and a metal plate with plastic partially injected around it is inserted into the head into the corresponding wall of the opening in the head and oriented in a diagonal position such that when the free end of the flat strip is passed through the head opening it abuts the corresponding flat side of the flat strip and forms an acute angle with the insertion direction of the flat strip. As a result, the free end of the flat strip can be inserted but the end of the flat strip is prevented from being pulled back through the head opening, resulting in a loosening of the cable tie, by the metal plate which cooperates in the manner of a barb with the respective side of the flat strip. It makes no difference if the side of the flat strip in question if profiled because the metal plate cooperates in a suitably restricting fashion by its sharp edge with a smooth plastic surface.

The goal of the invention is to provide an improved cable tie, based on this prior art, which is distinguished by the same or better retention reliability by improved handling ability.

This goal is achieved according to the invention by virtue of the fact that, in contrast to the state of the art described above, instead of the metal plate cooperating with a flat side of the flat strip, two metal plates are inserted opposite one another into the head of the cable tie, and cooperate with both edge surfaces of the flat strip.

In an embodiment especially provided for cable ties with small dimensions, the two opposite metal plates are replaced by two opposite edges of a Vcut in a single metal plate.

In the cable tie according to the invention, the total extent of the linear contact between the two metal plates and the opposite edge surfaces of the flat strip amounts to only a fraction of the linear contact between the single metal plate and the flat side of the flat strip of the known cable tie, but nevertheless the retention reliability is equally good or even better because the two opposite metal plates, because of their bilateral arrangement, cooperate more intensively with the edge surfaces of the flat strip, embed themselves correspondingly easily in the edge surface because of the very short contact length, and as a result form very effective barbs that very reliably prevent a loosening of the tightened cable tie.

On the other hand, the cable tie according to the invention has the advantage over the known cable tie that the insertion resistance or the pullthrough resistance of the free end of the flat strip through the head opening is much less with the metal plate located therein than in the known cable tie, which comes from the much shorter total linear contact between the metal plates and the edge surfaces on the flat strip that cooperate with them. The resultant reduction, for example halving, of the insertion and pull-through resistance of the cable tie according to the invention relative to the known cable tie may appear unimportant in the case of a single cable tie, but constitutes a considerable advantage when the situation of an assembly workforce is considered which must install many hundreds of such cable ties each workday.

An embodiment of the invention is shown in the attached drawings and will be described briefly in detail below. The drawing shows the following:

Figure 2:
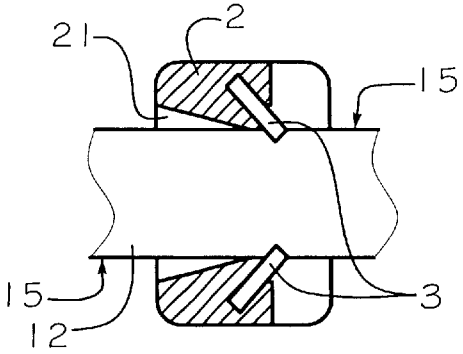
FIG. 2 is a side view of the cable tie according to FIG. 1.

As can be seen from the drawings, the cable tie consists of a flat strip 1 made of plastic with a head molded integrally on one end of the flat strip. Flat strip 1 has a section 11 that abuts the head 2 for wrapping around a cable bundle or the like and an adjacent, somewhat narrower fastening section 12 for insertion into and pulling through a suitably shaped opening 21 in head 2. The fastening section 12 is provided with a profiled area 13 in order to facilitate gripping it as it is pulled through the head opening 21, and has a conically tapered front end part 14 that facilitates insertion into the head opening 21.

Figure 3:
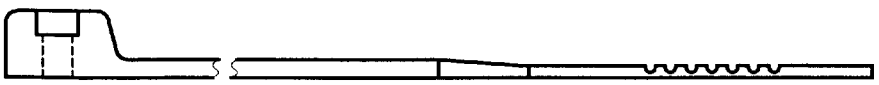
FIG. 3 is an enlarged view of a section through the cable tie head along section line III—III in FIG. 1, with the flat strip end pushed through, and FIG. 4 is a variation on the cable tie according to the invention.

As can be seen from the cross section through the head according to FIG. 3, in the head 2 in which the head opening 21, that has a suitably narrow rectangular shape matching the flat strip cross section of the flat strip fastening section 12, has two metal plates 3 located opposite one another on its walls bordering the narrow sides. These plates have injected around them in their respective rear areas the plastic that forms head 2 and each have a diagonal sealing component that extends in the pull-through direction of the flat strip fastening section 12 through the head opening, as shown in FIG. 3.

In FIG. 3 the flat strip fastening section 12 inserted into the head opening is shown looking toward one of its flat sides. As one can see, the free ends of the metal plates 3 that project into the head opening each cooperate barb-fashion with the two opposite edge surfaces 15 of the flat strip fastening section 12. The fastening section of flat strip 12 can therefore be easily inserted into the head opening (in the direction of the arrow in FIG. 3), while a backward movement of the fastening section in the head opening is opposed by the two metal plates 3, which press with their edges slightly elastically into the edge surfaces of the flat strip, exerting a powerful retaining force.

Figure 4:
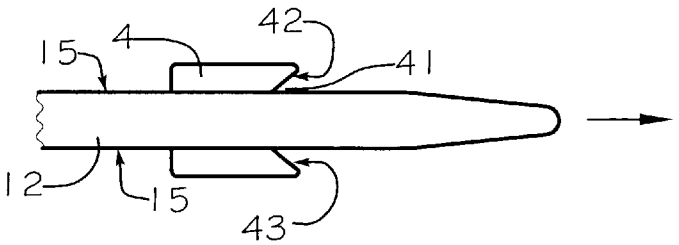
Figure 1:
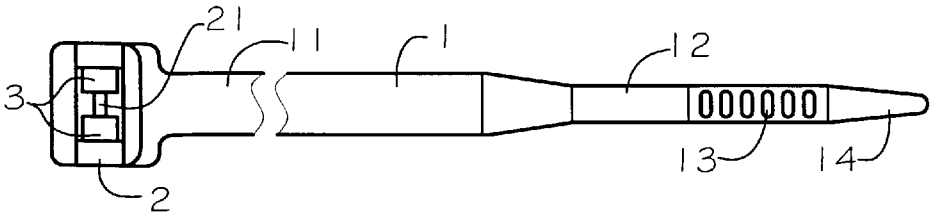
FIG. 1 is a top view of the cable tie according to the invention.

FIG. 4 shows an embodiment according to the invention that is especially intended for flat strip cable ties with small dimensions. The special nature of this embodiment consists in the fact that instead of two separate metal plates which, as described with reference to FIGS. 1 to 3, cooperate with the two opposite edges of the flat strip, two opposite edges of a V-cut in a of single metal strip are provided.

FIG. 4 does not show the entire cable tie but, for the sake of clarity regarding the embodiment under discussion here, only the single metal strip 4 inserted in the head (not shown) of the cable tie, said strip having a V-shaped cut 41 that projects into the head opening of the cable tie and whose two opposite edges 42 and 43 cooperate with the two marginal edges 15 of the cable tie flat strip or its anterior fastening section 12.

The metal strip 4 forms an acute angle by its principal plane with the cable tie flat strip, with this acute angle pointing in the pull-through direction of the cable tie flat strip through the head opening. As can easily be seen, the two opposite edges 42 and 43 of the V-shaped cut 41 of the metal strip 4 cooperate barb-wise with the opposite marginal edges 15 of the cable tie flat strip and prevent it from slipping back, in the same effective manner as the opposite, separate metal plates 3 in the embodiment according to FIGS. 1 to 3.

What is claimed is:

1. A cable tie having a flat strip made of plastic with two opposite edges, comprising:

a head integrally formed on a rear end of the flat strip having a flat pull-through opening for inserting and pulling through a front section of the flat strip, the head having a metal strip that is inclined into the plane of the flat strip and having a V-shaped cut with two edges and a width greater than the width of the front section of the flat strip;

an interior cross-section of the pull through opening roughly corresponding to a cross-section of the front section of the flat strip; and an end point of the flat strip in a pull-through direction having two opposite edges with comers;

wherein:

when the front section of the flat strip is pulled through the metal strip in the head, the metal strip forms an acute angle with the flat strip that points in the pull-through direction, and the two opposite edges with comers of the flat strip cooperate with the two edges of the V-shaped cut in the inclined metal strip to oppose a backward movement by the flat strip.

* * * * *